US011064826B2

(12) United States Patent
Son et al.

(10) Patent No.: US 11,064,826 B2
(45) Date of Patent: Jul. 20, 2021

(54) INFLATABLE PILLOW WITH ADJUSTABLE HEIGHT

(71) Applicant: GoSmart Inc., Los Angeles, CA (US)

(72) Inventors: Jae S. Son, Rolling Hills Estates, CA (US); Brandon M Larson, El Segundo, CA (US)

(73) Assignee: Go Smart Inc., Hawthorne, CA (US)

( * ) Notice: Subject to any disclaimer, the term of this patent is extended or adjusted under 35 U.S.C. 154(b) by 678 days.

(21) Appl. No.: 15/984,879

(22) Filed: May 21, 2018

(65) Prior Publication Data

US 2018/0332983 A1 Nov. 22, 2018

Related U.S. Application Data

(63) Continuation-in-part of application No. 15/600,770, filed on May 21, 2017, now Pat. No. 10,485,363.

(51) Int. Cl.
*A47G 9/10* (2006.01)
*A47G 9/00* (2006.01)

(52) U.S. Cl.
CPC ..... *A47G 9/1027* (2013.01); *A47G 2009/003* (2013.01)

(58) Field of Classification Search
CPC ..... A47G 9/1027; A47G 2009/003
See application file for complete search history.

(56) References Cited

U.S. PATENT DOCUMENTS 795,108 A * 7/1905 Doellinger ..... A47G 9/10 5/644
2,943,621 A * 7/1960 Phillips ..... A61H 23/0218 601/57
3,950,799 A * 4/1976 Frank ..... A61B 5/113 600/534
4,066,072 A * 1/1978 Cummins ..... A61B 5/6892 601/15
4,088,124 A * 5/1978 Korner ..... A61H 1/001 5/674
4,093,944 A * 6/1978 Muncheryan ..... A61M 21/00 340/407.1
4,862,533 A * 9/1989 Adams, III ..... A47C 27/081 5/413 R
4,979,249 A * 12/1990 Meade, II ..... A47C 27/081 5/644

(Continued)

*Primary Examiner* — David R Hare
*Assistant Examiner* — Alexis Felix Lopez
(74) *Attorney, Agent, or Firm* — Boris Leschinsky

(57) ABSTRACT

A novel pillow is provided to easily adjust its height by pulling a lever on the side of the pillow to activate the air control valve configured to personalize the head support needed for that individual. Pulling the lever to a fully open position creates a larger air passage to the inflatable bladder and activates an air pump for rapid inflation of the pillow so as to increase its height. With a user head laying over the pillow, pulling a lever slightly opens up a smaller opening suitable for gradual deflation of the pillow and reducing its height caused by the pressure generated by the head. Soft comfort portion on top of the pillow enclosed in a stretchable fabric reduces surface tension and creates a softer feeling for the user thereby improving comfort and consequently sleep quality. An altimeter may be incorporated with the bladder to easily monitor sleep patterns of the user.

19 Claims, 13 Drawing Sheets

(56) References Cited

U.S. PATENT DOCUMENTS

| | | | | | |
|---|---|---|---|---|---|
| 5,068,933 | A * | 12/1991 | Sexton | A47C 27/082 | 5/644 |
| 5,771,514 | A * | 6/1998 | Wilhoit | A47G 9/1027 | 5/421 |
| 5,898,963 | A * | 5/1999 | Larson | A47G 9/1027 | 5/644 |
| 6,047,425 | A * | 4/2000 | Khazaal | A47G 9/1027 | 5/640 |
| 6,327,725 | B1 * | 12/2001 | Veilleux | A47G 9/0253 | 5/644 |
| 6,510,573 | B1 * | 1/2003 | Grabe | A47G 9/1027 | 5/490 |
| 6,951,038 | B1 * | 10/2005 | Ganoe, Sr. | A47G 9/1027 | 5/636 |
| 7,383,599 | B2 * | 6/2008 | Gabbay | A47G 9/1027 | 128/845 |
| 7,588,425 | B2 * | 9/2009 | Chung | A47C 27/082 | 417/315 |
| 9,510,689 | B2 * | 12/2016 | Kearse | A47C 27/088 | |
| 10,201,236 | B1 * | 2/2019 | Cloud | A47G 9/1045 | |
| 10,806,279 | B2 * | 10/2020 | Berney | A47C 20/027 | |
| 2003/0014819 | A1 * | 1/2003 | Richardson | A47G 9/1027 | 5/644 |
| 2006/0005314 | A1 * | 1/2006 | Lee | A47G 9/1081 | 5/644 |
| 2016/0066716 | A1 * | 3/2016 | Rao | A61B 5/01 | 5/644 |
| 2017/0071371 | A1 * | 3/2017 | Zhang | A47G 9/1027 | |
| 2017/0113580 | A1 * | 4/2017 | Dry | B60N 2/3013 | |
| 2020/0187685 | A1 * | 6/2020 | Jeong | A47G 9/1027 | |

* cited by examiner

INFLATABLE PILLOW WITH ADJUSTABLE HEIGHT

CROSS-REFERENCE DATA

This patent application is a continuation in part of and claims a priority benefit from a U.S. patent application Ser. No. 15/600,770 filed May 21, 2017 by the same inventors and with the same title, which is incorporated herein by reference.

BACKGROUND

This invention relates to improvements in pillows such that an improved pillow allows the neck of a person who is lying on a bed to be in a neutral and comfortable position regardless of their size or the type of mattress that they are sleeping on. Various embodiments of the improved pillow allow a user to easily adjust its heights.

For a sleeping pillow to be comfortable, it must satisfy two very different and frequently conflicting requirements:

i. throughout the entire sleeping time, the pillow must support a neck and a head of a user so as to assure normal, generally straight alignment of a spine—see FIG. 2*b*, and ii. it also must distribute the pressure under the user's head so as to make it comfortable for the skin on the head and face of the user to rest on the pillow. This may be called Tactile Comfort.

Conventional pillows are generally made in a rectangular shape in one of only a few sizes and are generally filled by a plush down, or polyfill material. However, when a person's head is on the pillow, the soft compliant materials compress dramatically over time. Consequently, many people try to compensate by using multiple pillows stacked on top of one another which leads to too much compression of the pillow or sleep with the arm underneath the pillow to provide the necessary support. Manufacturers are reluctant to provide a broad range of pillow sizes due to increased production and inventory costs. These pillows frequently address the second requirement of distributing contact pressure by providing soft external surface for the head of the user to rest on but fail to satisfy the first requirement of providing proper and consistent height to keep the spine straight.

There are other fill material pillows known in the prior art that use buckwheat or memory foam to provide more support—but this is accomplished at a price of reduced tactile comfort as these pillows fail to broadly distribute contact pressures leading to reduced comfort.

Generally speaking, a conventional pillow has uniform thickness. When such pillow is too thin (too low) comparing to a distance corresponding to about half of the width of a user's shoulders, the neck of the user lying sideways bends downwards—see FIG. 2*c*. To keep a side-lying user's neck straight, a thicker or stiffer pillow must be used to provide higher support when a head is rested on the pillow. But, when the pillow is too thick such as when using two pillows (too high), the neck of the user bends upwards—see FIG. 2*a*. The bent neck may pinch various nerves in the neck, in particular those nerves that come out from the Foramen inter-vertebrates. The pinches may hamper the relaxation or the rest of the nerves and may eventually cause pain in the upper body of a user. Nerve pinch can of course happen when there is not enough support as well. Therefore, a pillow that allows a user to keep a straight neck during sleep is needed.

Frequently, a user resorts to using not one but a stack of two pillows, folding the pillow, or placing their arm under the pillow to assure a proper height. In addition, the fill material of a pillow has a disadvantage of being slowly compressed throughout the sleeping time causing a conventional pillow to gradually reduce its height overnight. Improper height of the pillow therefore causes discomfort and lack of a good night sleep.

In addition, conventional pillows do not allow for height adjustment tailored to a specific individual's size, in particular shoulder width, mattress firmness and user preference, which could change depending on a sleeping position.

Some known camping pillows are at least partially filled with foam pieces. These pillows feature a turn-on and turn-off valve to control air volume inside the pillow. A user can turn the valve on to open access to the inner inflatable bladder, then the user can inflate or deflate the pillow to a desired state and then the user needs to turn the valve off. Not only this is a long procedure, but it is difficult to adjust the pillow for comfortable sleep while the head of the user is on the pillow because it requires two hands to operate the valve. Another disadvantage of these pillows is that the pillow often does not inflate to the maximum height unless the person blows into the valve since the size of the opening is limited making the inflation too restricted. These pillows may also not be optimal when it comes to the choice of foam and fill density since they are designed for camping.

There is a need therefore for an improved pillow which satisfies all of the above requirements.

SUMMARY OF THE INVENTION

Accordingly, it is an object of the present invention to overcome these and other drawbacks of the prior art by providing a novel pillow, which after initial height adjustment supports the head and neck of the user in a position aligned with the spine.

It is another object of the present invention to provide a new pillow which allows for an easy and rapid height adjustment, both in terms of increasing the height as well as decreasing the height of the pillow.

It is a further object of the present invention to provide a pillow shaped to support the head the user and the neck of the user at separate sections of the pillow so as to assure proper spine alignment, individual neck and head support and maximum user comfort.

It is yet a further object of the present invention to provide a pillow with built-in quiet wake-up alarm mechanism configured to wake up the user at a specified time but not disturb a partner.

It is yet another object of the present invention to provide a pillow capable of detecting and recording user sleep patterns, user motion during the night, how the user felt during the day, as well as a record of what sort of activities, diet or lifestyle choices were made. These recordings may be done with an objective to provide recommendations as to how to improve sleep quality.

The main concept of the present invention is to provide a pillow which combines a soft and stretchable top comfort layer with a function of rapid adjustment of the pillow height to fit individual user requirements by using an inflatable portion located underneath.

The pillow 100 of the present invention is generally shown in FIGS. 1*a* and 1*b* and includes an inflatable lower portion 130 supporting from at least underneath a top comfort portion 110. The comfort portion 110 may be made using a soft stretchable knitted material so as to avoid surface wrinkles and tension when in use while at the same time surrounding the head of the user laying on the pillow. The top comfort section 110 may be filled with any known pillow fill materials such as down, memory foam, polyfill, etc. The entire pillow may be enclosed in an optionally stretchable pillow cover 180. That creates a sense of superior tactile comfort for the user.

The inflatable portion 130 of the pillow is aimed at supporting from below and adjusting the height of the top comfort portion 110 and includes an inflatable stretchable bladder configured for adding more air to the bladder or for removing some volume of air from the bladder. According to the experiments conducted by the inventors, different size air-in and air-out openings are required for rapid adjustment of the pillow: a greater opening size is needed for rapid inflation of the bladder and a smaller opening size is needed for slow deflation of the pillow so as to achieve the desired height. A unique air valve and pump control may be provided in the air control unit 140 of the pillow to achieve this configuration by employing a large cross-sectional area throughout the valve assembly and precise adjustment capabilities of the valve diaphragm. As described in greater detail below, pulling an L-shaped lever of the air valve to an intermediate "slow deflation" position opens up a smaller opening to the inflatable bladder allowing for controlled deflation thereof and reduction in height of the pillow 100. Pulling the lever to a fully open "inflation" position opens up a greater opening of the passage into the inflatable bladder and at the same time activates an air pump for rapid inflation of the bladder. This may be accomplished via automatically depressing a switch at the end of the valve stem travel.

Pillow inflation in other embodiments may also be caused via using compressed foam structures placed inside the bladder. In these embodiments, a natural relaxed position of such foam structures may be selected to urge inflation of the pillow when the head is not on it and the air valve is open so as to increase the pillow height. When foam pieces are used, the amount of height variation between compressed and uncompressed state is limited, but a geometrical structure such as a circle or a tube as shown in FIG. 14 below may allow larger variation between the compressed and uncompressed states thus supporting a wider range of shoulder sizes.

A quiet wake-up vibration alarm may also be provided to silently wake up the user and not disturb others. This may be accomplished by momentarily turning the air pump on and off so to just cause pillow vibration which can only be felt by the person on the pillow and not inflate the bladder. The frequency and amplitude of the vibration can be controlled using a pulse width modulation (PWM) technique.

An altimeter exposed to the internal volume of the inflatable bladder may also be provided. Altimeters are used conventionally to measure atmospheric pressure to determine the elevation of a person or a drone using a very sensitive pressure sensor. The present invention uses this sensor to determine the pressure inside the bladder, which can accurately determine if the user's head is on or off the pillow, i.e. pillow time, as well as head motion during sleeping. This recording throughout the night may be used as an indicator of how well the person slept.

The pillow with the sensor and the air pump may be connected via a wireless link such as BTLE to a mobile phone, tablet, personal computer or another electronic device equipped with a microprocessor in order to collect sleep data as well as set smart silent vibration alarm that wakes the person at the optimal time of light sleep so as to prevent grogginess.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF THE PREFERRED EMBODIMENT OF THE INVENTION

Figure 1A:
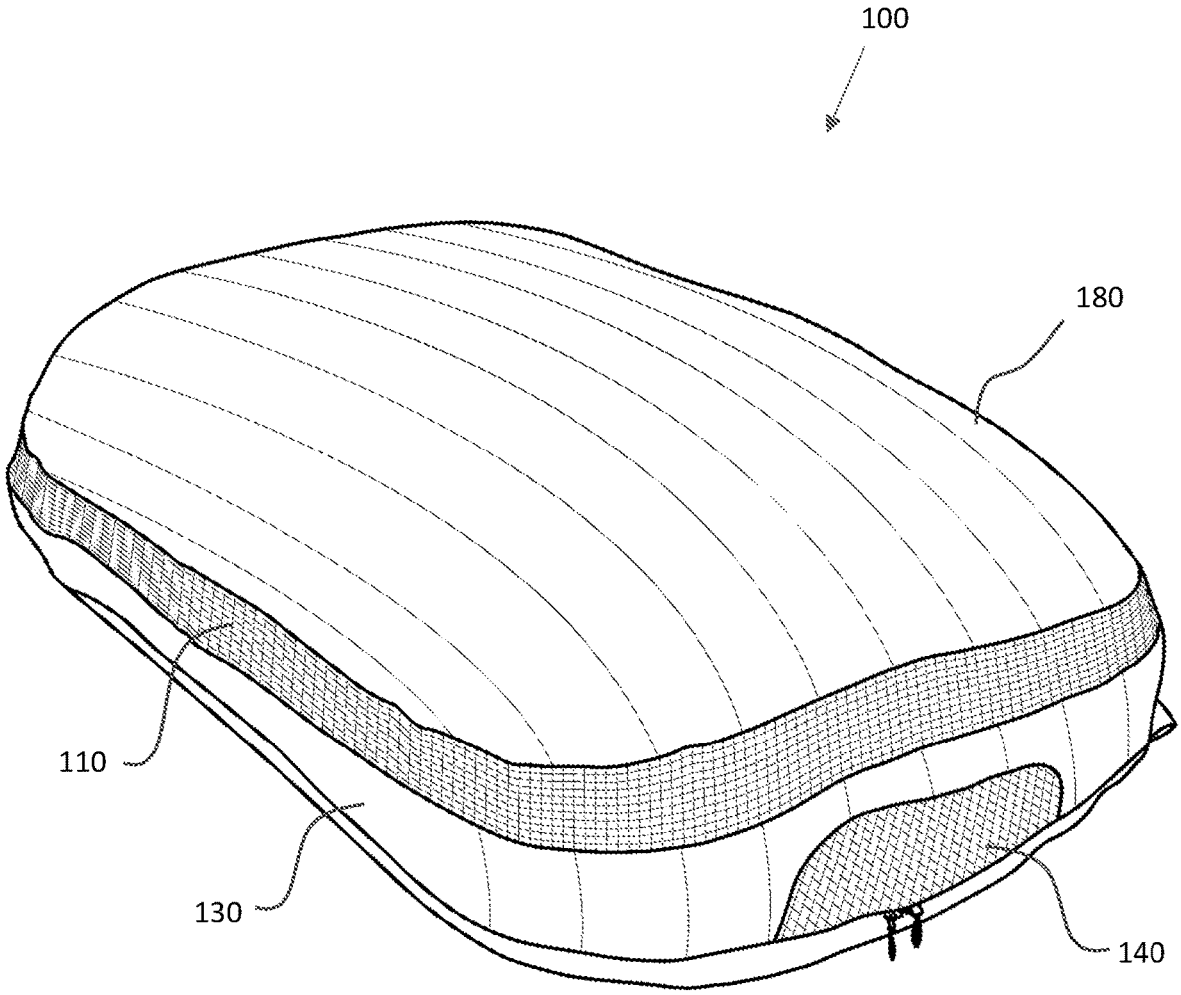
FIG. 1*a* is a general view of the pillow of the present invention.

The following description sets forth various examples along with specific details to provide a thorough understanding of claimed subject matter. It will be understood by those skilled in the art, however that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Figure 1B:
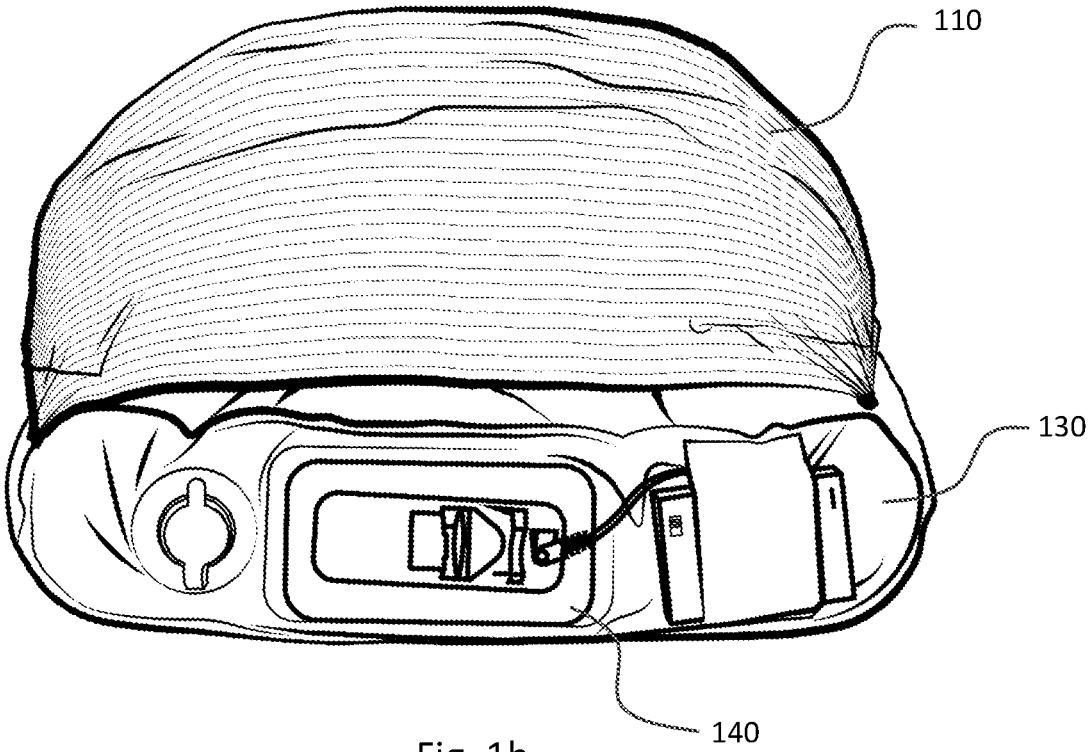
FIG. 1*b* shows a general view of a stretchable comfort portion of the pillow above the inflatable lower portion of the pillow.
Figure 1C:
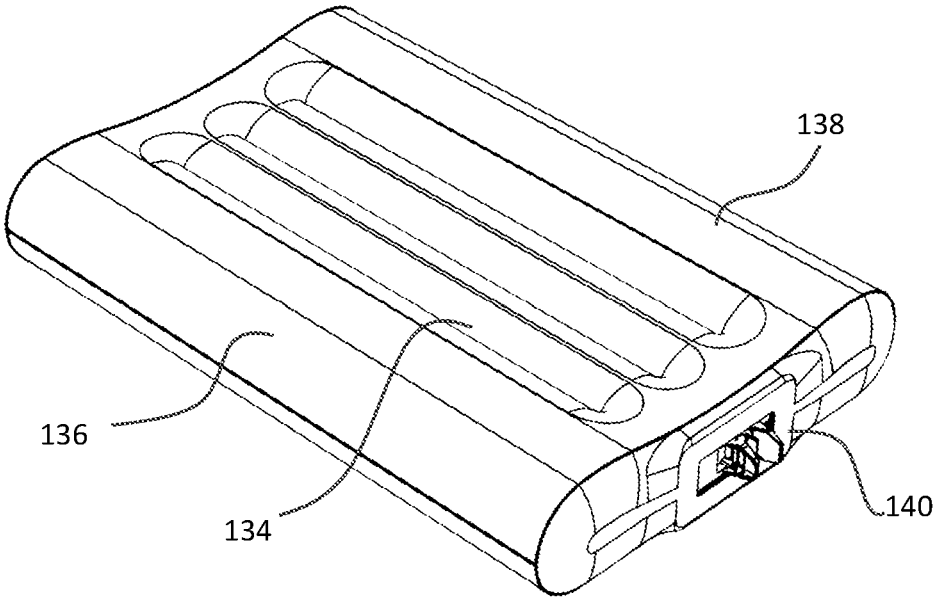
FIG. 1*c* shows the height adjustable portion of the pillow.
Figure 7:
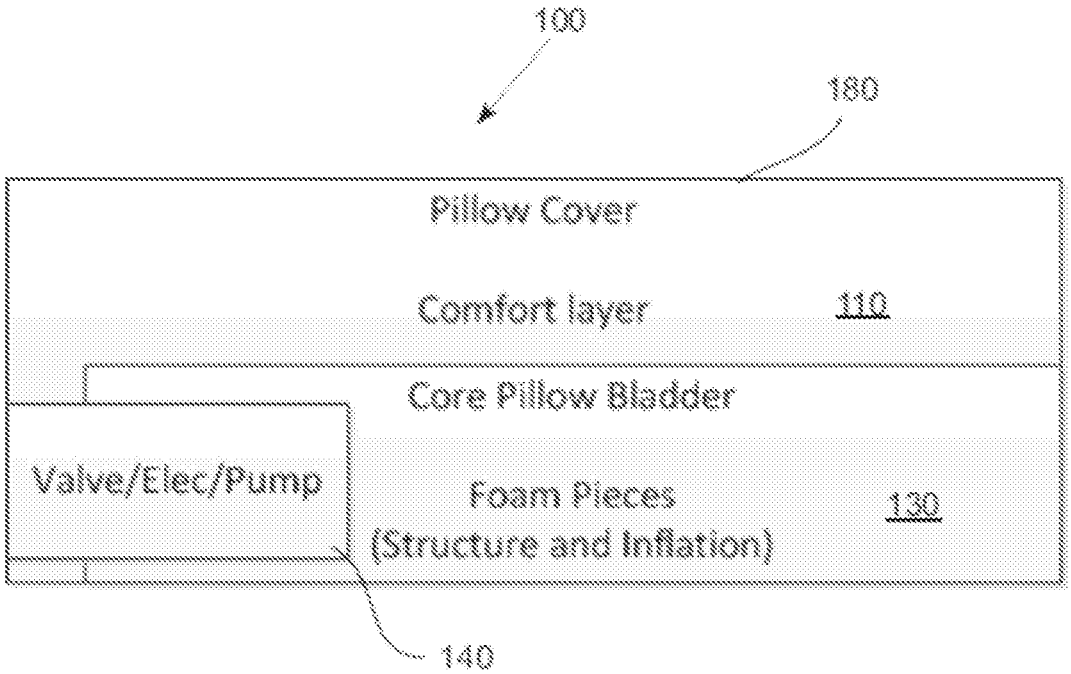
FIG. 7 is a block-diagram of the pillow of the present invention.

FIG. 1 a shows a general view of the pillow 100 of the present invention and FIG. 7 shows a general block diagram thereof. The pillow 100 includes a comfort top portion 110 supported underneath by an inflatable lower portion 130. Although in this illustration the comfort portion 110 is seen as covering the lower portion 130 on top only, it is also contemplated to have the comfort portion 110 surrounding more or even the entire lower inflatable portion 130 on all sides or just on a top and on the bottom. Both the lower inflatable portion 130 and the top comfort portion 110 may be enclosed in a pillow cover 180 made from suitably soft and comfortable fabric, which is preferably a stretchable knitted fabric to reduce the amount of wrinkles and surface tension in the fabric. In embodiments, the lower portion 130 may be attached to the upper comfort portion 110 and not be enclosed in a pillow cover 180. A manual or electrically operated air control unit 140 may be provided to facilitate adding air into the bladder or removing air therefrom in order to adjust the pillow height.

In embodiments, the top comfort portion 110 may include an optional dedicated cover containing the fill material. Alternatively, other embodiments may contain a single piece of fill material or several pieces of fill material attached together and arranged to represent the top comfort portion 110 without a dedicated cover holding the fill material together.

Conventional pillows are typically made from woven fabric that does not stretch, such as cotton. However, this fabric also creates surface membrane tension similar to a hammock. Consequently, the pressure distribution underneath the person's head is not uniform. To address this deficiency, the pillow of the invention in at least some embodiments combines the use of a soft polyfill material inside a stretchable knitted mesh that may be positioned on top of the inflatable portion 130. In this case, the inflatable portion 130 may act close to a partially filled balloon—so as to lift the top comfort portion 110 of the pillow and a person's head to a specifically desired position, see FIG. 1*b*. The entire pillow may be wrapped in a stretchable knitted material 180 to provide very soft feel through uniform pressure distribution (i.e. improved tactile comfort).

In embodiments, a variety of fill materials can be used for the purposes of supporting the user head and distribute pressure over the larger surface of the pillow 100. Down, polyfill, polyester, polyester pellets, microbeads, beanbag fillers, wool, shredded rubber, memory foam, polyurethane foam and other traditional materials may be used individually or in combination to fill the volume of the upper comfort portion 110 as the present invention is not limited in this regard.

Figure 2A:
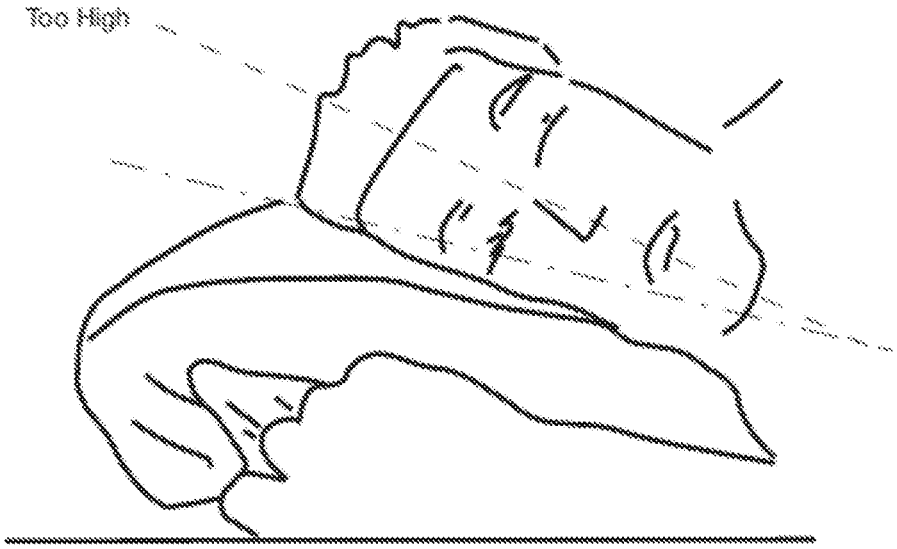
FIG. 2*a* is a side view of a user on a pillow, which is too high.
Figure 2B:
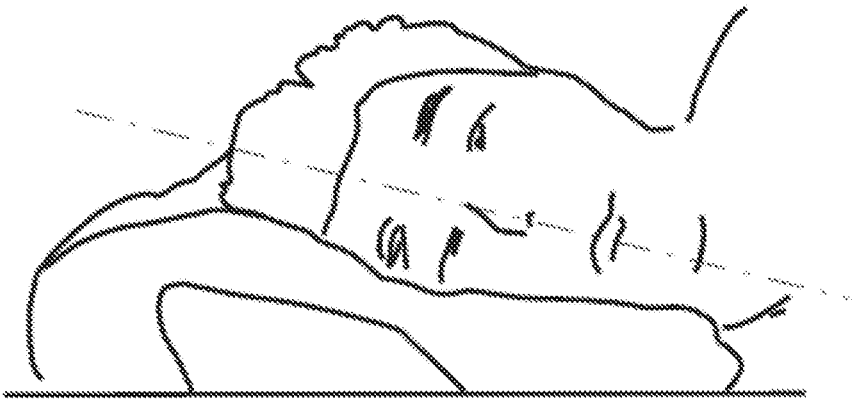
FIG. 2*b* is a side view of a user on a pillow, which is optimal.
Figure 2C:
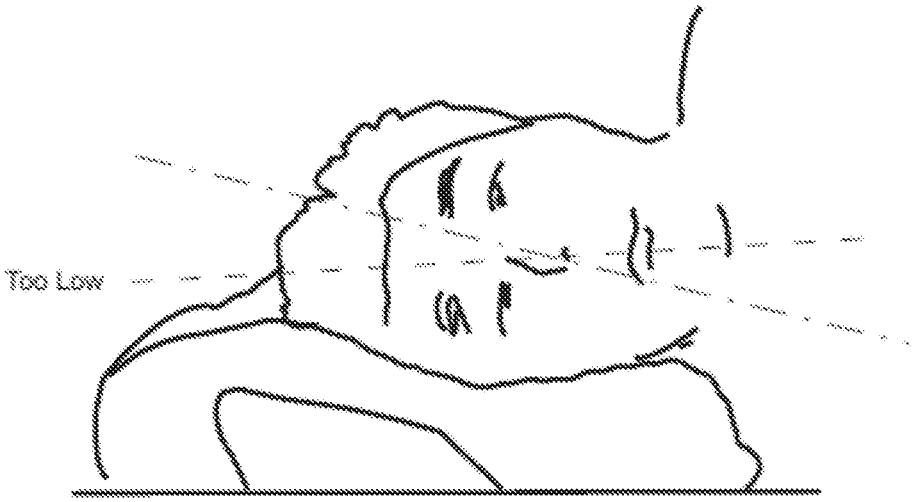
FIG. 2*c* is a side view of a user on a pillow, which is too low.

Before describing the lower inflatable portion of the pillow, it is important to discuss the need for height adjustment in greater detail. To achieve a good night sleep, it is important to allow muscle relaxation of all parts of the body. When it comes to an upper portion of the body, it is desirable to keep the head aligned with the general center line of the spine. For a side sleeper, this translates into a necessity to select the mattress softness along with the height and softness of the pillow appropriately. Selecting too high of a pillow tends to cause bending of the head upwards as seen in FIG. 2*a*. Too soft of a pillow or a shallow pillow tends to allow the head to bend downwards—see FIG. 2*c*. Proper alignment is seen in FIG. 2*b*. Utilizing a lower inflatable portion 130 of the pillow may help in adjusting the pillow height to a desired level for a variety of individual users, whereby making it universally satisfactory for a broad range of customers, while at the same time reducing the cost of producing a large number of sizes and servicing a large inventory of products at a store.

Figure 3:
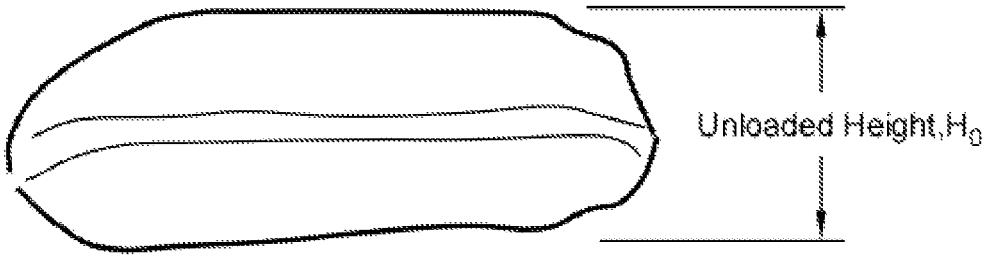
FIG. 3 is a general side view of the pillow in an unloaded state.

To further improve the ease of use of the pillow with an adjustable height, the inventors of the present invention have conducted a number of tests to evaluate the best inflation and deflation practices for an inflatable pillow. FIG. 3 shows an intact unloaded pillow characterized by initial undisturbed height $H_o$.

Figure 4:
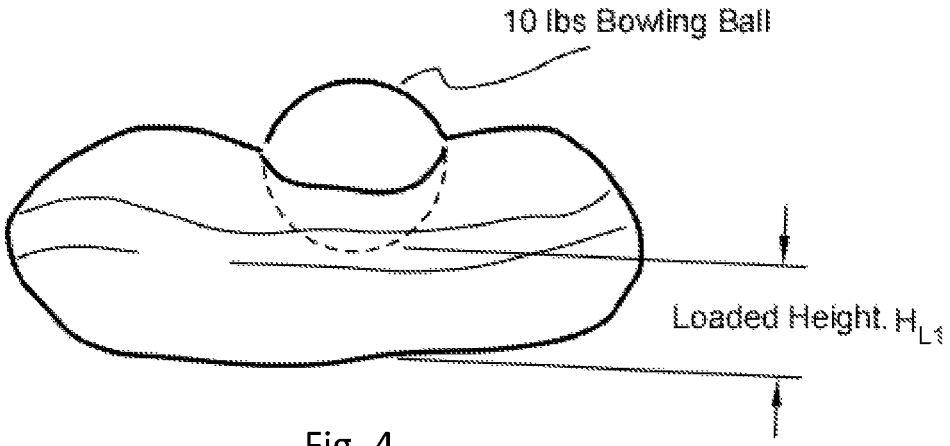
FIG. 4 is the same in a loaded state with a predefined load.

The tests were performed with a 10 lb bowling ball placed in the middle of the pillow and used to represent a typical human head—see FIG. 4. Placing the ball on the pillow results in a depression of the pillow height to a loaded height of $H_{L1}$ when the bladder is fully inflated.

Figure 5:
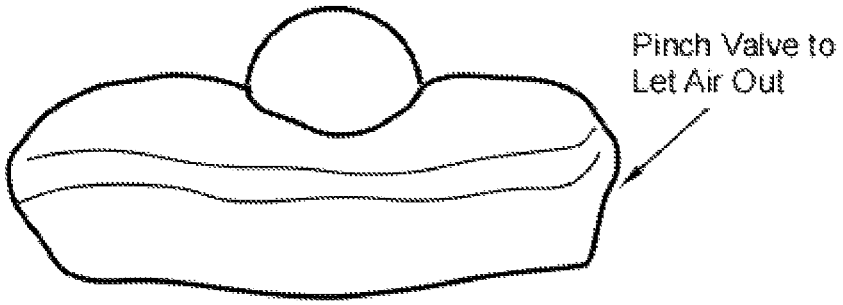
FIG. 5 is the same as in FIG. 4 but with the air valve activated for deflation adjustment of the pillow under load.
Figure 6:
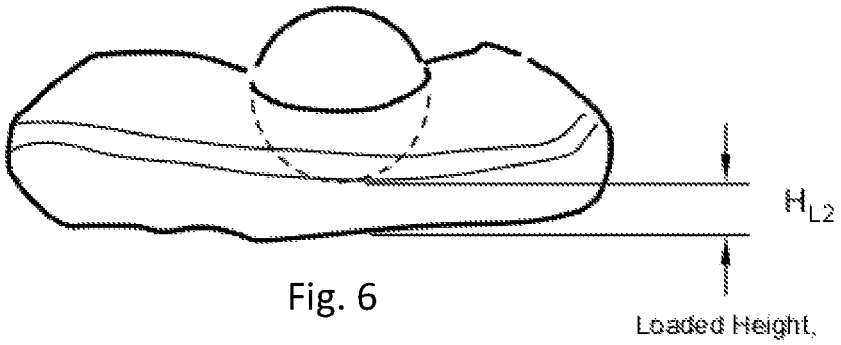
FIG. 6 is the same showing the height of the pillow after adjustment.

Tests to examine the impact of various size openings between the internal inflatable bladder of the pillow and atmosphere were conducted by releasing air from the bladder. One way to accomplish such release is via using a pinch valve (see FIG. 5)—releasing air causes the bladder to deflate at a rate corresponding to the size of the opening resulting in a lower pillow height $H_{L2}$—see FIG. 6.

Importantly, this test simulates the most preferred conditions of how the pillow height needs to be adjusted—while the user's head is resting on the pillow. In that case, the pressure differential urging the air out of the bladder is defined by the weight of the head—therefore simulating real life conditions. The rate of deflation needs to be slow enough to allow for a fine adjustment of the pillow height—deflating too fast would not allow the user to properly adjust the height of the pillow and to try different positions of the pillow while using it. At the same time, too small of an opening would cause excessively slow deflation of the pillow and therefore extending the time for the adjustment procedure unnecessarily.

These experiments resulted in a determination of an optimum size of a total opening during deflation, which is fast enough to be convenient and yet slow enough to allow for fine adjustments. In embodiments, the size of the bladder opening suitable for convenient deflation may be about 0.15, 0.20, 0.25, 0.30, 0.35 $in^2$ or any number inbetween.

In a separate series of tests, inventors of the present invention evaluated the minimum size of the opening needed for rapid inflation of the pillow. It was determined that a suitable total opening size needed for rapid inflation under 15 seconds is about 0.25 $in^2$.

In embodiments, the cross-sectional area of an opening to the inflatable bladder may be at or above about 0.40 $in^2$ in order to achieve pillow inflation of about 10 seconds or less. Other openings may also be used such as 0.15, 0.20, 0.3, 0.4, 0.5 $in^2$ or any number inbetween.

As a result of these experiments, it became apparent that a suitable rate of pillow deflation when a user head is on the pillow and pushing it down is quite different from the suitable rate of pillow inflation. In embodiments, it may be desired to have a rate of pillow deflation be lower than the rate of pillow inflation. To achieve this difference between the rate of pillow deflation and pillow inflation, the pillow of the present invention features a design allowing to change the cross-sectional area of the air passage leading to the inflatable bladder.

In some embodiments, the adjustment of the air passage opening may be made in a staged way. In other words, the opening size during deflation may have a smaller fixed value while the opening size during inflation may have a larger fixed value. In other embodiments, the size of the opening may be adjusted gradually over a range of values covering both preferred inflation and preferred deflation rates.

Figure 8:
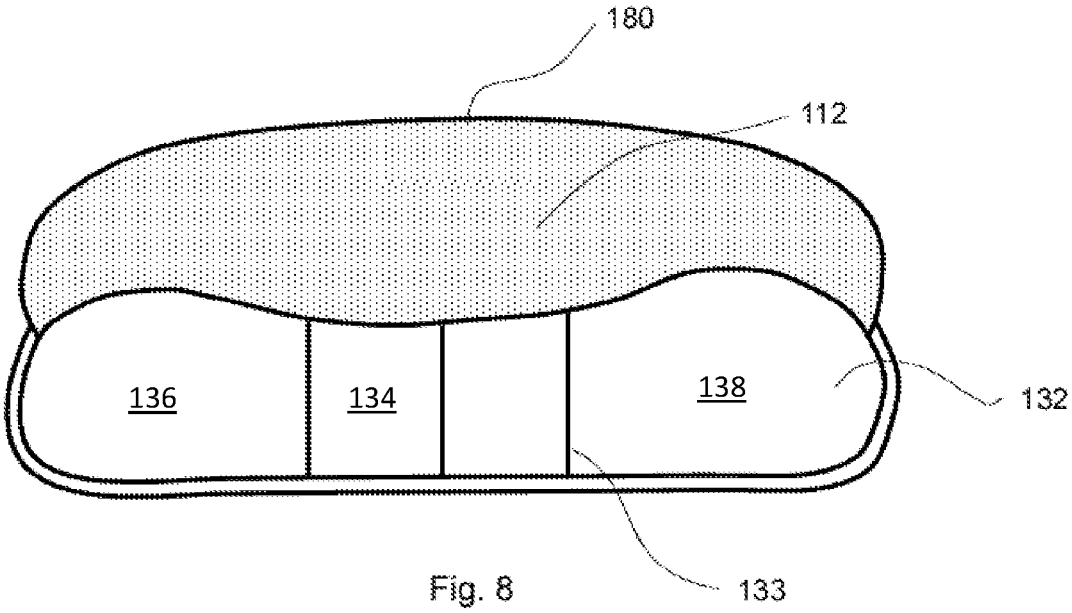
FIG. 8 is a general cross-sectional view of the pillow of the invention.
Figure 9:
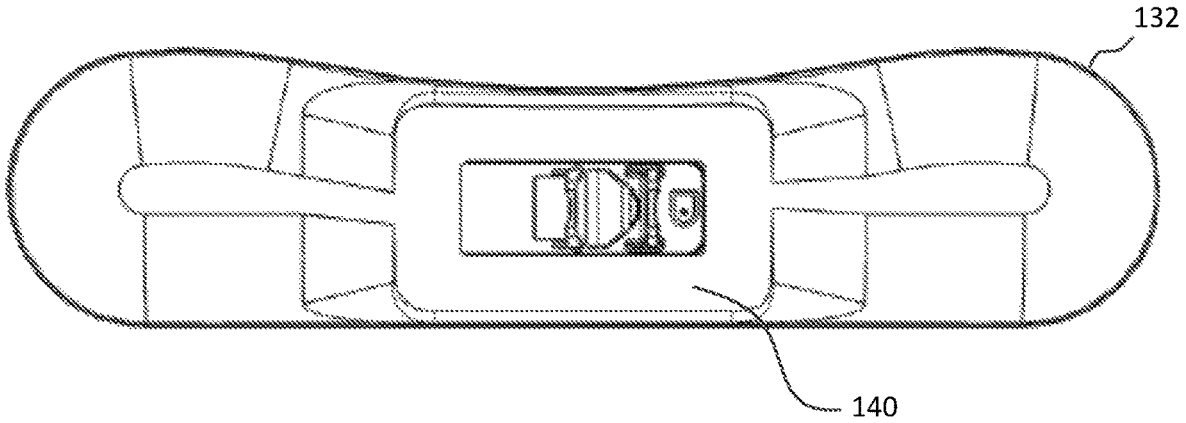
FIG. 9 is a general side view of the inflatable bladder of the pillow.
Figure 10:
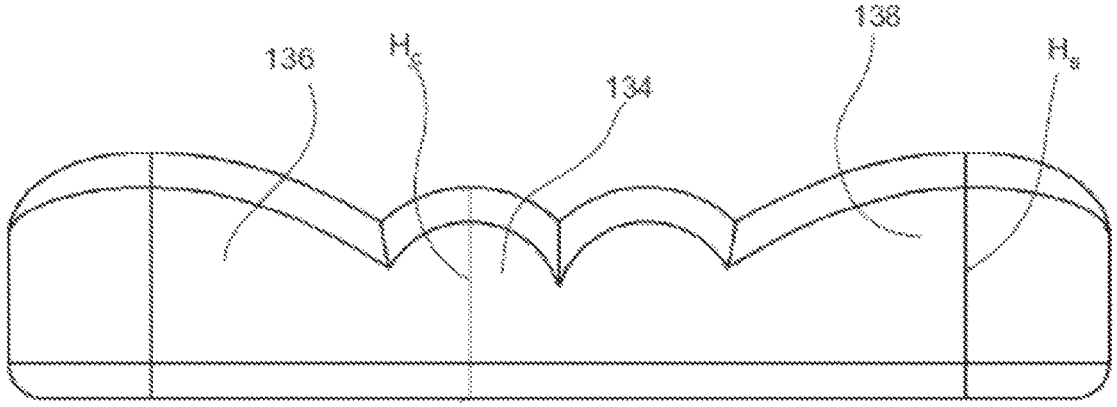
FIG. 10 is a cross-sectional view of the inflatable bladder.

A general conceptional cross-sectional view of the pillow of the present invention is seen in FIG. 8. A pillow cover 180 is shown containing the fill material 112 located on top of the inflatable bladder 132. The bladder 132 may be shaped as a general rectangle and sized from about 9"×4" to about 15"×22". Using intermediate ribs 133, the bladder 132 may be shaped to include three sections: a central section 134 of smaller height $H_c$ may be located inbetween side sections 136 and 138 of greater height $H_s$—see FIGS. 8 through 14. In embodiments, the height $H_c$ of the central section 134 of the unloaded bladder 132 may be from about 2" to about 5", while when in use that height may be reduced to about 0.5" to 3". At the same time, the height $H_s$ of the side portions 136 and 138 may be from about 2" to about 7". This arrangement is designed to provide deeper cradle for the head of the user located over the section 134 of the pillow while at the same time supporting the neck of the user located over a side section 136 or 138 of the bladder 132.

A typical PVC bladder used in conventional inflatable pillows of the prior art is inflated such that it's membrane tension provides a firm and well defined inflated shape of the bladder. Consequently, it provides the desired shape of the inflatable item such as a mattress, pillow or an animation figure. While using such materials to make a bladder of the present pillow is possible, in at least some embodiments the present invention may use a bladder made from a cloth laminated with and sealed by a thin polyurethane or another polymer layer to provide soft elastic feel thereto. This approach would not have a final defined inflated shape and it is not used therefor to create a shape of a pillow, but to function as a lifting device that elevates a soft comfort layer on top of the inflatable bladder 132.

Figure 11:
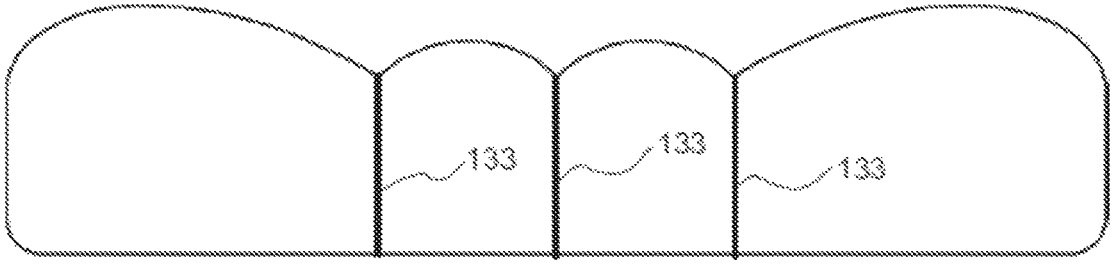
FIG. 11 is another general cross-sectional view of the inflatable bladder.
Figure 12:
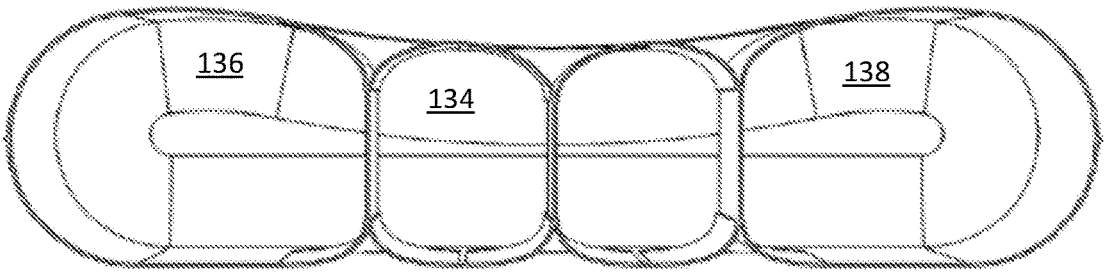
FIG. 12 is another cross-sectional view of the air-filled inflatable bladder.

In embodiments, the bladder 132 may be filled with only air as seen in FIG. 11. In other embodiments, the bladder 132 may be at least partially filled with a fill material—see FIG. 13. Having at least some foam inside the inflatable bladder 132 may be advantageous for a number of reasons:

i. it provides for initial inflation of the bladder 132 due to natural foam expansion,
ii. it provides for some resiliency of the bladder even without support from air pressure,
iii. it allows for a better control of the shape of the inflatable bladder 132, and
iv. it dampens oscillations and bouncing around when the user moved his head.

For all these reasons, this design may be advantageous for use in manually-inflatable hollow pillows. The fill material inside the bladder 132 may be the same or different from the fill material of the upper comfort portion 110. In embodiments, the fill material of the bladder 132 may be selected to be more elastic and less soft than the fill material of the upper comfort portion 110 so as to provide better support for the user, while the upper comfort layer 110 can provide for a greater pressure distribution to increase tactile comfort.

The present invention contemplates passive as well as assisted inflation of the bladder 132. In case of a passive inflation, a simple blow-in tube may be provided at the end of the bladder opening. Such tube may be designed to be tucked away under the bladder once pillow adjustment is complete. Another way to cause passive inflation is to allow the inflatable bladder to expand based of expansion of the internal foam, which may have been previously compressed for storage purposes.

Figure 13:
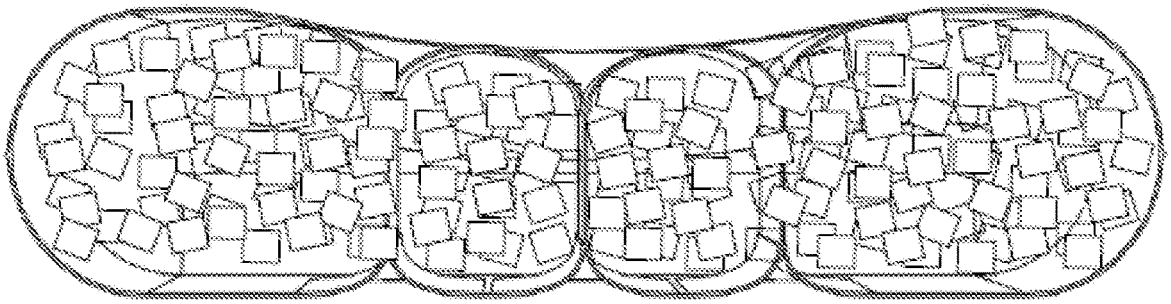
FIG. 13 is a cross-sectional view of the air-filled and foam-filled inflatable bladder.
Figure 14:
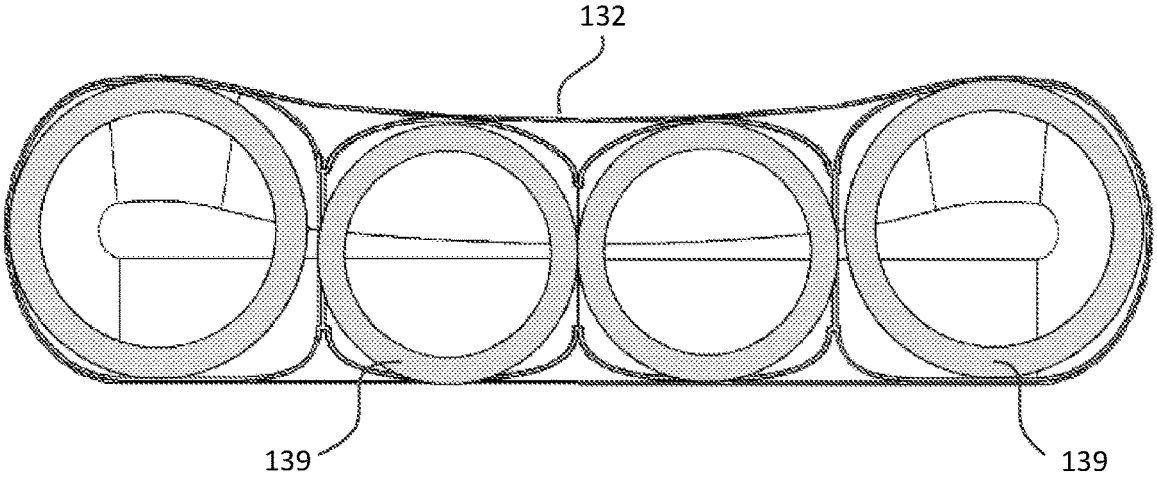
FIG. 14 is a cross-sectional view of the air-filled inflatable bladder containing resilient foam tubes.

The stiffness of reticulated foam is much greater than that of a polyfill material so such foam is conventionally shredded or cut into small pieces to fill inside a pillow that is typically used for camping since it can be compressed to a small size for travel. One alternative way to inflate the bladder is to use a circular foam tubes 139 (see FIG. 14) inside at least one, some or inside every section of the bladder 132. The foam tube 139 can be compressed much more than small pieces of foam as seen in FIG. 13. This approach would eliminate the need for a motor to inflate the pillow. The shape of the tube may be selected to match the size of each section of the inflatable bladder so that compressed foam pieces or the foam tube would urge the inflatable bladder to expand to its inflated shape when the foam is not constrained.

A variety of mechanisms may be deployed to adjust the size of the air passage opening into the bladder, such as valves, manifolds, etc. To be convenient, such mechanism must be small, easily reachable and simple to operate by feel and without looking, even in a dark room. In this case, a simple and quick adjustment to the pillow height may be made by a user while resting a head on the pillow.

Figure 16:
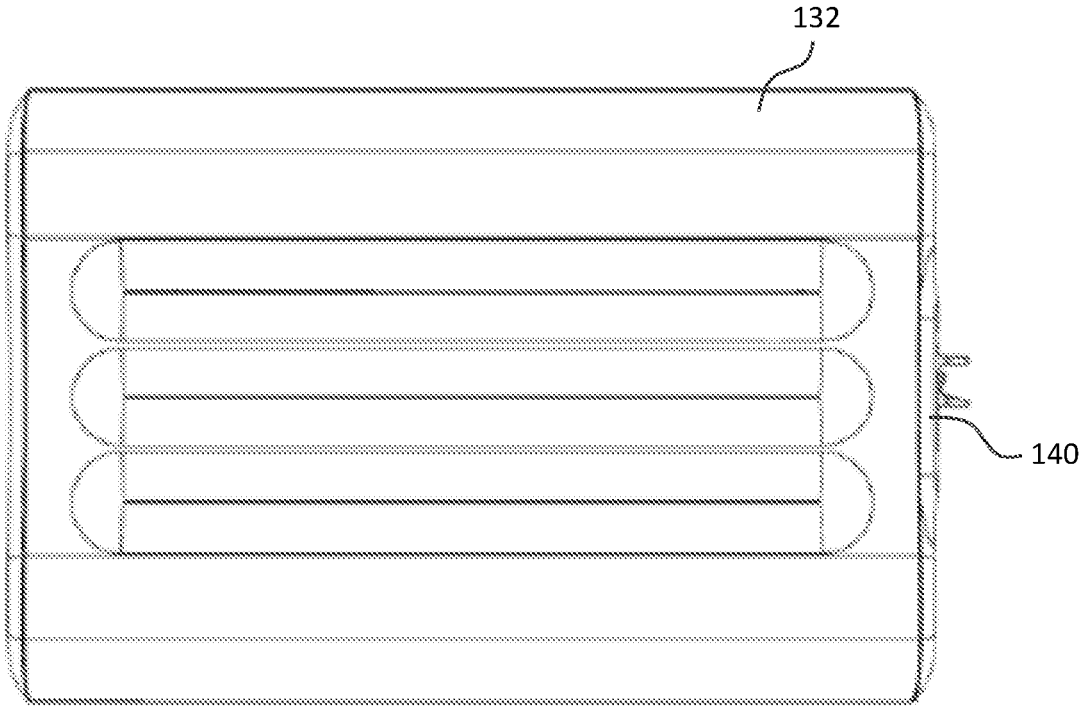
FIG. 16 is a top view of the inflatable bladder of the present invention, FIGS. 17 (*a*), (*b*), and (*c*) are respectively a top, a side, and a bottom view of the control unit of the inflatable portion of the pillow.
Figure 17A:
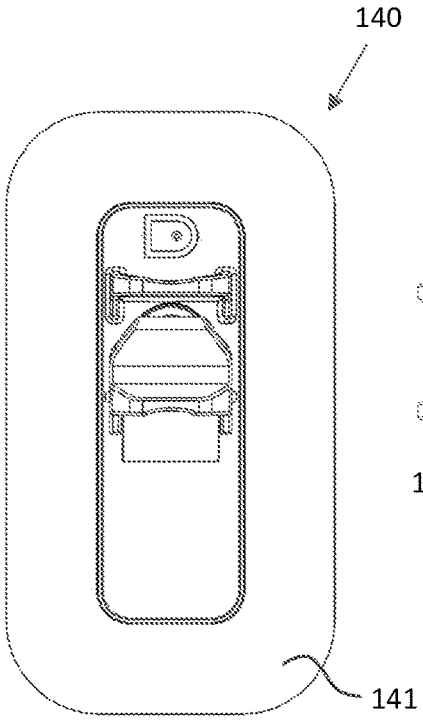
FIG. 17*d* is an isometric view of the control unit of the invention.
Figure 17B:
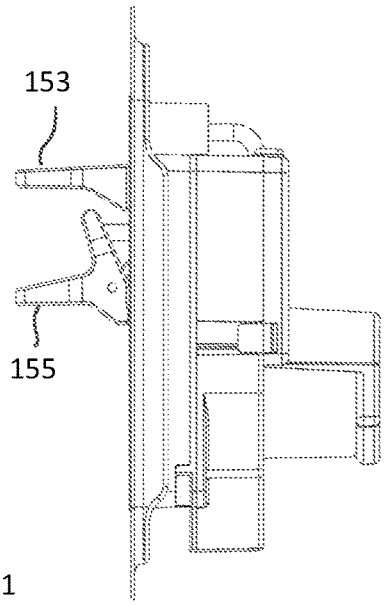
Figure 17C:
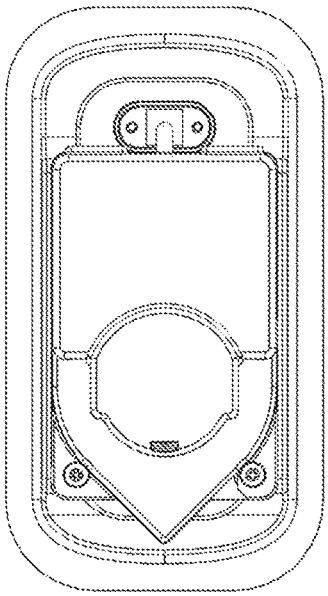
Figure 17D:
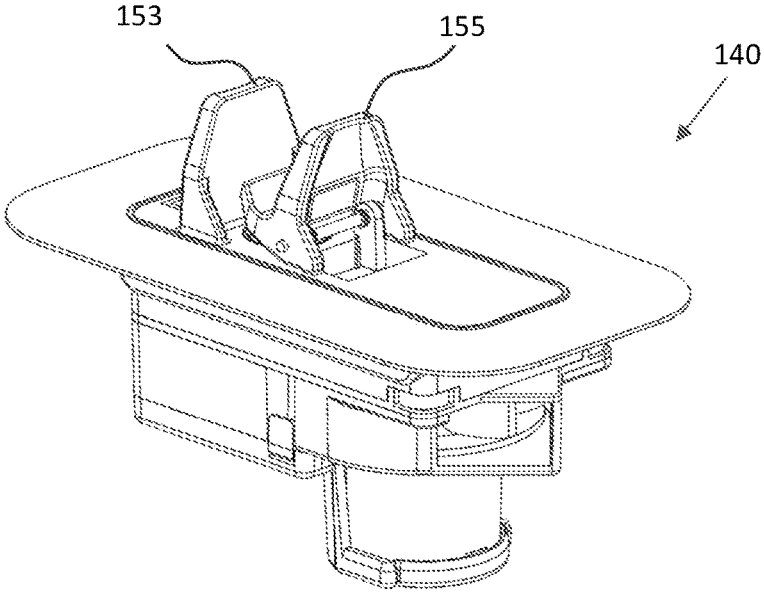

In embodiments, inflation of the bladder 132 may be conducted by an electrically driven air pump using an air flow control unit 140. In this case, the air control unit 140 may be incorporated into the inflatable bladder 132 (see FIG. 16) and may include all the elements needed for air handling procedure, including microprocessor, a battery, a motor, an air pump, and one or more valves to control the flow of air in and out of the bladder 132. The microprocessor and the control logic may be located either inside the pillow or may be external to the pillow and communicating with the pillow elements such as a pump, a valve and optional sensors by using a wired or wireless communication link. In embodiments, a small electronic device such as a cell phone, a tablet or a personal computer may be employed to provide control function and present the user with a graphic user interface to operate the pillow and set desired parameters thereof. Reference to a "control unit" contemplates all of these arrangements, both inside and outside the pillow.

Figure 15:
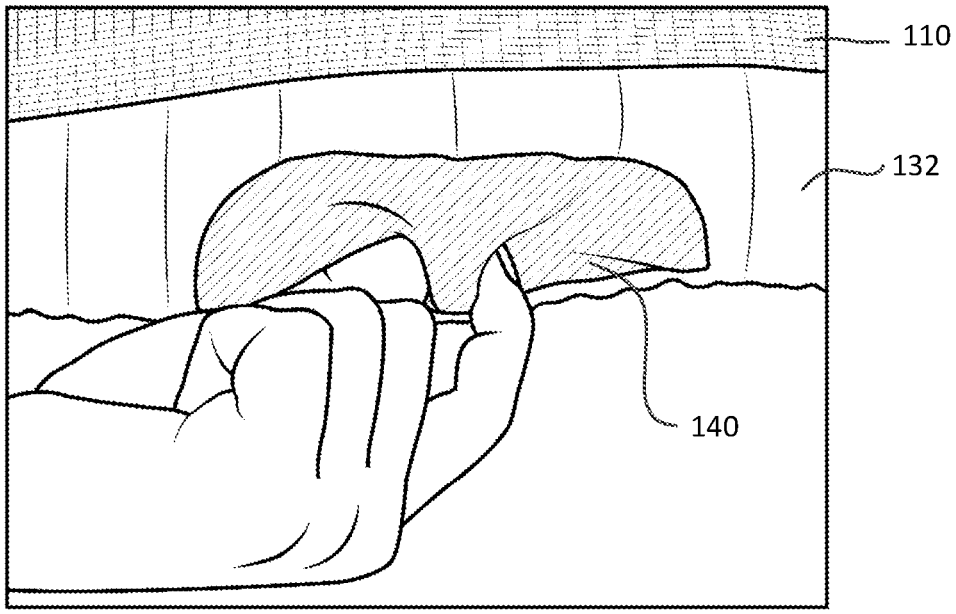
FIG. 15 is a view showing an operation of opening the valve of the bladder.

The air control assembly 140 may be built into the bladder 132 in such a way that only a control lever may protrude outwards therefrom—see FIG. 15. A closer view of the air control unit 140 is seen in FIGS. 17 (*a*) through (*d*). To facilitate attachment of the air control assembly 140 to the bladder 132, a polymer insert layer 141 may be incorporated with the air control unit 140 during assembly. In this case, the bladder 132 may be welded, glued or otherwise attached to the polymer layer 141 to sealingly assemble the air control unit 140 inside the inflatable bladder 132. The polymer material of the insert 141 may be selected to be the same or of similar content as the material used for making an inflatable bladder 132 so as to facilitate the welding or another method of attachment between the air control unit 140 and the inflatable bladder 132.

Figure 18:
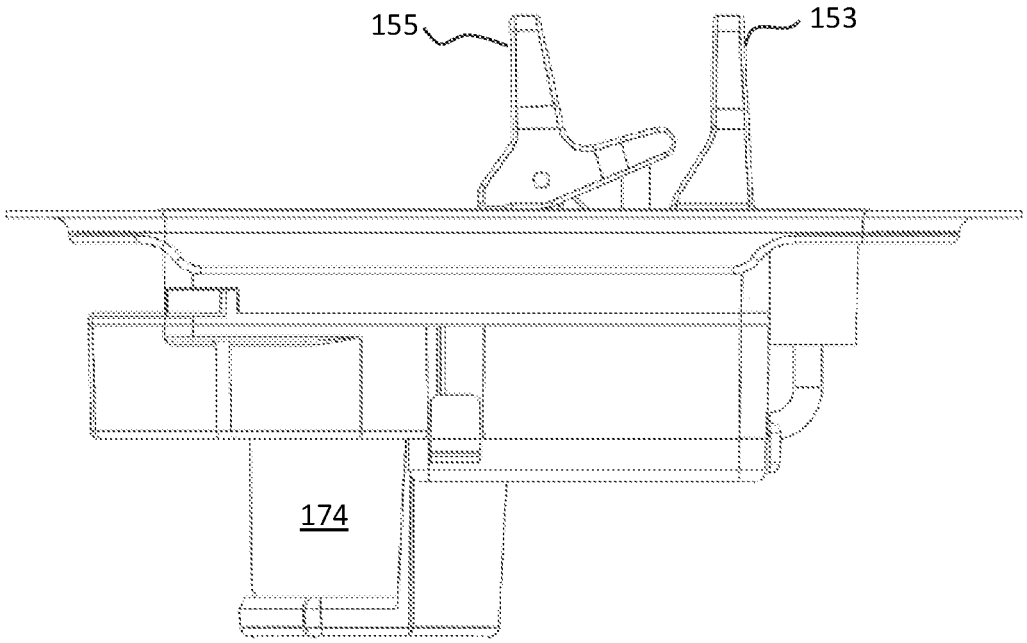
FIG. 18 is a general side view of the control unit showing an air valve levers on top in the initial position.
Figure 19:
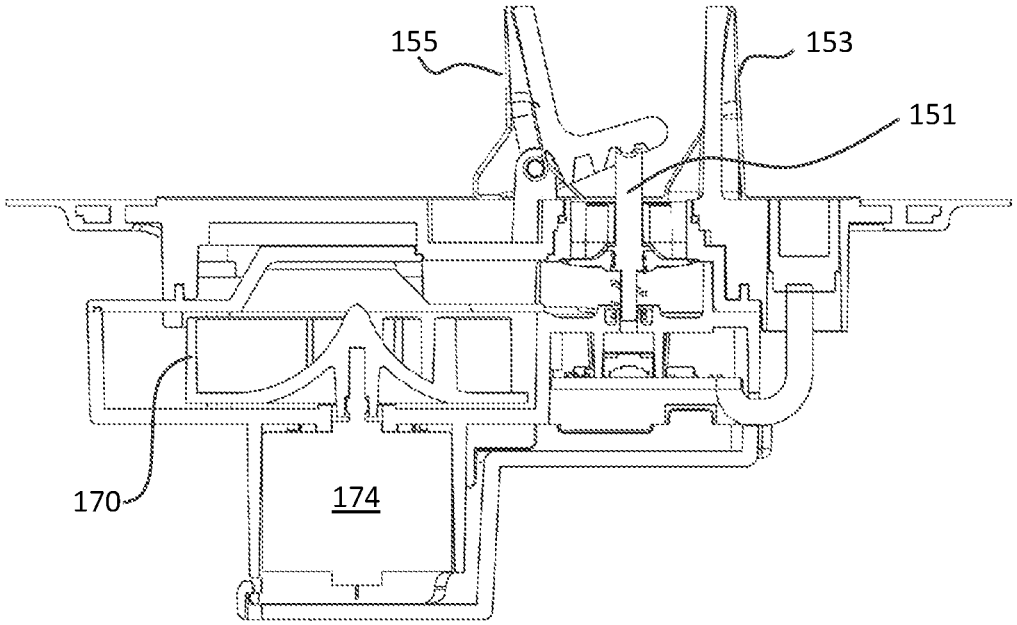
FIG. 19 is a cross-sectional side view of the same.
Figure 20:
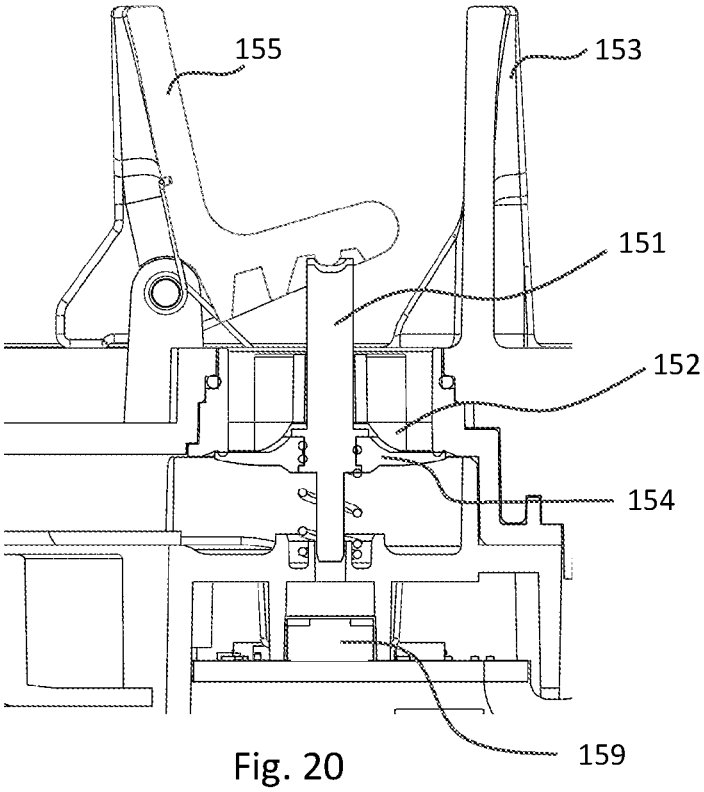
FIG. 20 is a cross-sectional side view of the air valve in its initial closed position.

The details of the air control assembly 140 are shown in FIGS. 17 to 19. The air control unit 140 generally includes an electrically-powered motor 174 rotating an impeller of the air pump 170. The motor 174 may be powered by a battery or another source of electrical power. The air pump 170 may be selected to provide enough air flow into the bladder 132 for rapid inflation.

Figure 21:
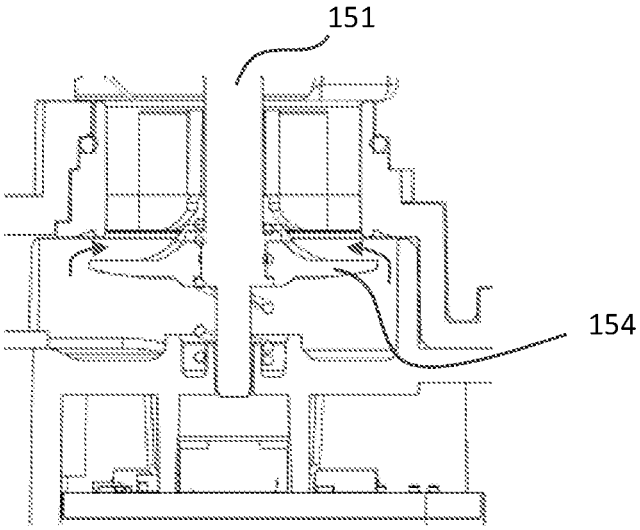
FIG. 21 is a close-up cross-sectional view of the air valve in an intermediate "slow deflation" position.

The valve portion of the air control unit 140 may be made using a movable spring-loaded L-shaped lever 155 positioned opposite a hard stop 153. The shape of the protruding portions of the lever 155 and the hard stop 153 may be made to allow the user to squeeze the lever 155 by pressing the end thereof towards the stop 153 when placing both the lever 155 and the stop 153 between two fingers of the same hand—see FIG. 21. The soft stretchable cover 180 may be configured such that both lever 155 and hard stop 153 may protrude from the pillow 100 while under the cover 180 and operation of the air valve may be accomplished by pushing the lever 155 through the stretchable material of the cover 180.

When the lever 155 is moved towards the hard stop 153, it causes a spring-loaded valve stem 151 of the air valve to move downwards from its normally-closed initial position to open air passage between the valve plate 154 and the valve seat or membrane 152—see FIGS. 20, 21, 22, and 23. The shape of the air passage formed when the stem 151 is moved downwards depends on the position of the stem 151: initial movement of the stem 151 from a closed position to an intermediate "slow deflation" position causes only a small air passage opening to be formed to allow slow deflation of the bladder. The size of that opening may be selected to match the experiments described above—about 0.15, 0.20, 0.25, 0.30, 0.35 $in^2$ or any number inbetween. This position is designed for slow deflation of the bladder and reduction of the pillow height caused by the weight of the user's head resting on the pillow.

Figure 22:
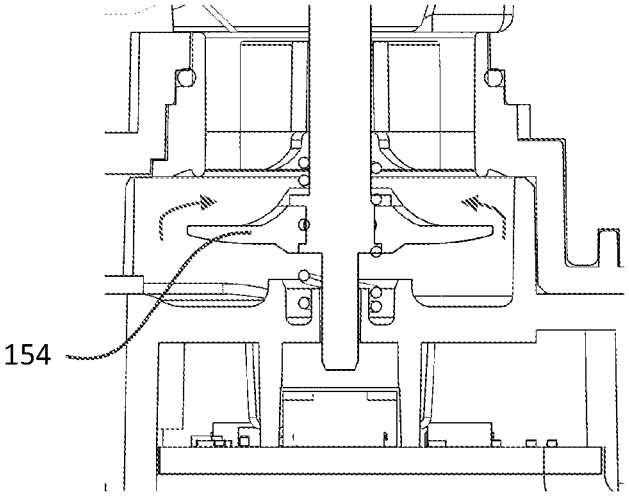
FIG. 22 is the same but with the valve in an open position for rapid inflation or deflation of the bladder.

As the stem 151 is urged by the lever 155 to move further down to a full open "inflation" position, the air passage opening may be increased to allow rapid inflation of the bladder—see FIG. 22. As described above, the full opening of the valve may open a size of the air passage to be about 0.15, 0.20, 0.3, 0.4, 0.5 $in^2$ or any number inbetween—that would allow inflating of the bladder 132 in under 15 sec when a suitable air pump is used. In embodiments, the shape of the air passage may be selected to allow continuously increasing air passage to be formed as the stem 151 is moved from a closed position to an open position—in that case the speed of bladder deflation may be progressively increased by further squeezing the lever 155 towards the hard stop 153.

In other embodiments, the shape of the air passage may be selected to be consistently small once the stem 151 is moved from a closed position to the open position and increase in size dramatically once the open position is reached. In this case, the user may not be concerned with fine adjustment of the bladder deflation—it will be the same at most positions of the lever 155 except its final position. This configuration may be preferred for the purposes of a simple two-stage adjustment.

Figure 23:
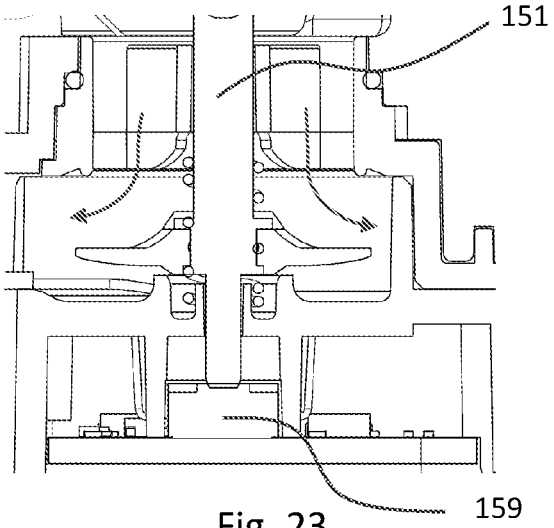
FIG. 23 is the same as FIG. 22 with the valve in a fully open position and with the electrical switch for the motor activated.
Figures 24A, 24B:
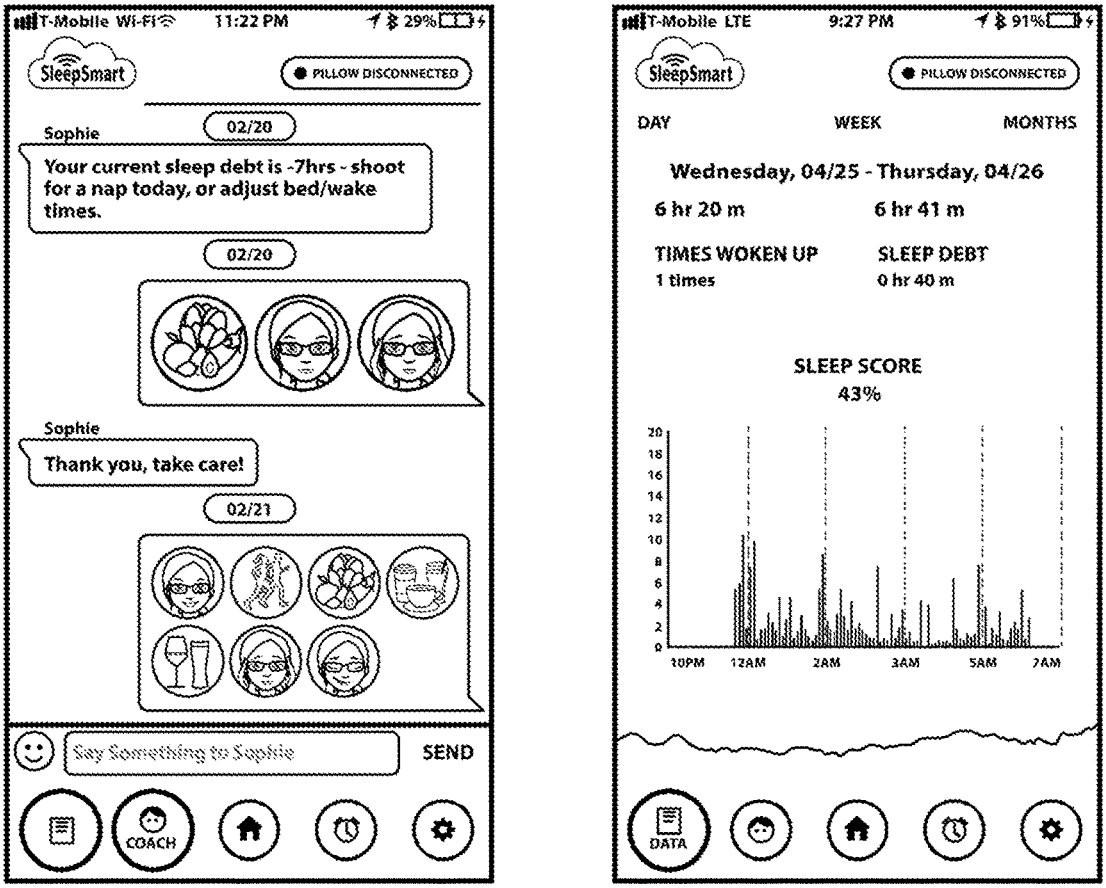
FIG. 24*a* is an exemplary depiction of a screen of graphic user interface used to collect data on how the user feels and activities in an interactive-messaging-like interface.
FIG. 24*b* shows exemplary motion data collected from the pillow that contains an altimeter.

The control unit 140 may be further designed to have the lower end of the stem 151 to activate the air pump switch 159 when it reaches the end of its travel—see FIG. 23. This would cause the pump to be automatically energized when the valve is in the open "inflation" position causing the bladder to be inflated. As the desired extent of inflation is achieved, the user may release the lever 155 causing inflation to stop and the valve to close. The control unit with a microprocessor may be used to modulate when the pump turns off. In one example, the switch 159 may directly connect the air pump to the source of power, in which case operating the valve away from the open "inflate position" would immediately cause the air pump to stop.

In other embodiments, the switch 159 may be connected to a controller in which case the controller may be programmed to execute a slight delay to switch the pump off, for example about 0.5 sec. In this case, when the lever is released, the pump is still operating to inflate the pillow during this delay so as to minimize inadvertent deflation while the valve is in the process of being closed.

Additional features may be provided by the novel pillow of the present invention. One such feature is a silent wake-up alarm. Traditional vibration alarms provided in various pillows of the prior art are not entirely silent. They utilize a dedicated motor, which is used to rotate a cam to create vibration, and in turn wake up a user at a resonance frequency which is typically in the range of audio frequencies. While effective, such systems are not silent, and may cause a partner of the user who sleeps nearby to wake up as well.

The present invention addresses this problem by providing a silent vibration alarm, which does not require any additional components other than what is already present in the pillow of the invention. The silent alarm is achieved by momentary use of the motor of the air pump as an optional vibration actuator. The control unit may be programmed to activate the silent alarm at the desired time of the day by pulsing (activating) the motor for short periods of time such as about 1-10 ms about every 2 sec or so. This use of the motor doesn't cause the motor to turn or pump to infuse any appreciable amount of air into the bladder—but creates a small vibration that only the person sleeping on the pillow can hear and feel. This eliminates the need for a separate vibration motor needed to create a silent alarm.

Another novel feature of the invention is incorporation of an altimeter to be exposed to the internal volume of the bladder 132. Altimeters are generally designed to measure atmospheric pressure and to determine the altitude of the user for applications such as mountain climbers, airplanes and drones. Altimeter is generally made using an absolute pressure sensor and detecting a reduction in pressure below an atmospheric pressure. They are not known to be used in the range of pressures higher than atmospheric pressure as this would indicate location of the user below sea level. Mass production of altimeters for use in cell phones and other common electronic devices makes them readily available and inexpensive. The present invention uses the altimeter located inside the bladder 132 as a pressure sensor to measure the sleep activity of the user. As the head of the user is rested on a pillow, the pressure inside the pillow increases above a previous steady baseline air pressure level. Detecting and recording of the bladder pressure by an altimeter both before and during sleep time may be useful in detecting the time when the user went to sleep, the time when the user woke up, how many times the user got up in the middle of the night as well as the relative motion of the user during the sleep as such motion would cause pressure fluctuations and variations inside the bladder of the pillow—and can be recorded using the altimeter or another pressure sensor.

Information from the altimeter may be used to determine all the movements of the user very accurately in comparison to using other sensors such as conventional accelerometers. This novel approach uses the pressure region of the altimeter which is typically not used, i.e. when the pressure increases above ambient baseline level indicating compression of the bladder presumably by a head of the user. An altimeter provides absolute pressure so it does not have to be vented to outside the bladder for simpler construction. Altimeters are also made in small sized making incorporation into the control unit 140 easier to accomplish.

The pillow of the present invention incorporating an altimeter and a silent alarm further allows to accomplish smart wake alarm—in embodiments, the controller 140 may be programmed to wake the user at the ideal light sleep state within a 30-minute window before the selected alarm time. Light sleep state may be detected when increasing head movement is identified. Awakening in a light sleep state reduces the feeling of grogginess and gives the person a more refreshed feeling.

However, if the person has been sleep-deprived or they simply need more sleep, the smart alarm doesn't provide as much benefit since that person needs as much sleep as possible. In that situation the user may hit the snooze button to activate a snooze request—to sleep a bit more. Generally, the duration of the snooze on a conventional alarm clock has been fixed based on historical limitations of mechanical watches. The present invention may further provide a smart snooze function using the sensor in the pillow that can accurately monitor user motion using an altimeter-provided data—the snooze duration can be adjusted to fit the person's needs, for example it would cause the activation of the silent alarm again when the person starts moving his head again above a predetermined threshold indicating being in a light sleep pattern—all within a predetermined period of snooze time interval set by the user.

Figure 25:
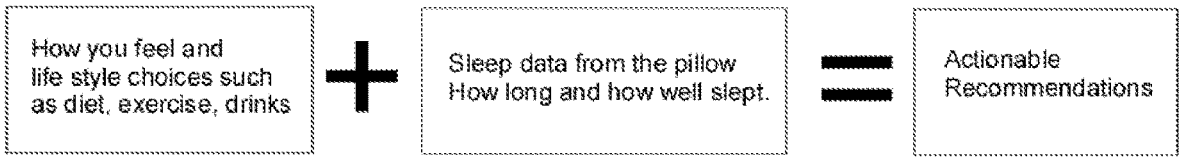
FIG. 25 is a general depiction of the process used to collect user sleep data from the pillow and combine it with user input data in order to develop better sleep recommendations.

How a person slept, other subjectively perceived quality of sleep data, as well as objectively recorded data such as duration of sleep and head motion through the night may be tracked accurately with the sleep tracking capabilities of the pillow of the present invention as described above. Incorporating a wired or wireless transmission capability into the pillow of the invention allows to establish a link with a smart mobile phone app or a computer program to record a variety of sleep parameters and combine them with the user input. Over time, such accumulated data may be used to track best sleep patterns and determine the best sleep practices for each individual user. The phone app may be used to combine the sleep data with information on how the user feels in the morning or throughout the day for example and what did the user do to help develop better insights on how to get better sleep. This may be accomplished with a simple graphic user interface (see FIG. 25) that lets the user select key activities and emotions. Correlation algorithms may be used to monitor trends in sleep data as well as lifestyle inputs to propose actionable suggestions on how to improve the quality of sleep.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, Aft AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, Aft BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. An inflatable pillow with adjustable height comprising:

a top comfort portion enclosed in a stretchable material, an inflatable portion located under said comfort portion and configured to raise said top comfort portion when inflated, said inflatable portion comprising an inflatable bladder with an air passage leading thereto and an air control unit, said air control unit in turn comprising an air inflation element and a three-position air valve operatively connecting the air inflation element to the inflatable bladder via the air passage and configured to both inflate and deflate the air bladder through the air valve and through the air passage, said air valve is configured to operate by moving between the following three positions:

a closed position in which said inflatable bladder is isolated and said air passage and the air valve are closed, an intermediate "slow deflation" position in which said air valve is partially open, said "slow deflation" position is configured for reducing a height of said inflatable pillow by releasing air from said inflatable bladder through the air valve and the inactivated air inflation element, and an open "inflation" position in which said air inflation element is activated and operated to infuse air into said inflatable bladder through said air passage, said air valve is fully open to an extent greater than in said "slow deflation" position, whereby adjustment of height of said pillow is conducted by operating said air valve between said closed position, said intermediate "slow deflation" position and said open "inflation" position.

2. The inflatable pillow as in claim 1 wherein said three-position air valve comprises a spring-loaded rocking L-shaped lever positioned across from and in close vicinity to a hard stop, wherein in neutral state the air valve is closed in a first position thereof, partial squeezing of said L-shaped lever towards said hard stop between two fingers causing partial depression of a spring-loaded stem of said air valve and partial opening of said air passage in a second position thereof, and full squeezing towards said hard stop causing full depression of the spring-loaded stem of the air valve in a third position thereof leading to full opening of the air passage and activation of the air inflation element to inflate the air bladder.

3. The inflatable pillow as in claim 2, wherein said stretchable material is extended to cover both said top comfort portion and said inflatable portion of said inflatable pillow including said air valve, said L-shaped lever and said hard stop protruding under said stretchable material whereby allowing operating said air valve through said stretchable material.

4. The inflatable pillow as in claim 1 further comprising said inflatable bladder filled at least partially with compressible foam pieces, said foam pieces configured for urging said inflatable bladder to expand to an inflated shape when not constrained.

5. The inflatable pillow as in claim 1, wherein said inflatable bladder contains one or more compressible foam tubes, said one or more foam tubes configured to urge said inflatable bladder to expand into an expanded shape when said one or more foam tubes are not constrained.

6. The inflatable pillow as in claim 1, wherein said inflatable bladder comprising a central section having a height lower than a height of side sections thereof.

7. The inflatable pillow as in claim 1, wherein for monitoring quality of sleep, said pillow further comprising an altimeter exposed to the air pressure inside said inflatable bladder, and a controller configured to detect and record air pressure inside said inflatable bladder using said altimeter, said controller is further configured to operate said altimeter in a pressure range equal or above ambient air pressure.

8. The inflatable pillow as in claim 7, wherein said controller is further configured to detect time intervals when said pillow is in use corresponding to time intervals when said air pressure is above an air pressure baseline level, said air pressure increase caused by compression of said pillow by a head of a user.

9. The inflatable pillow as in claim 7, wherein said controller is further configured to detect head motion over said pillow by detecting air pressure variations above said air pressure baseline level.

10. The inflatable pillow as in claim 1, wherein said air inflation element is an electrically-powered air pump.

11. The inflatable pillow as in claim 10, wherein said control unit is configured to de-activate said electrically-powered air pump after a predetermined delay following switching said air valve away from said open "inflate" position.

12. The inflatable pillow as in claim 1, wherein said air inflation element is compressed foam constrained within said inflatable bladder upon deflation thereof.

13. The inflatable pillow as in claim 12, wherein said air inflation element is a compressed foam tube.

14. The inflatable pillow as in claim 10 further equipped with a silent alarm, said silent alarm caused by intermittent activation at user selected times of said air pump for periods of time sufficient to cause vibration internal to said inflatable pillow but insufficient to cause inflation of said inflatable bladder.

15. The inflatable pillow as in claim 14, wherein said control unit is further configured after activation of a snooze request to adjust snooze duration using an altimeter-based motion detection of the head on said inflatable pillow, said silent alarm is activated once said altimeter-based motion detection exceeds a predetermined threshold within a snooze time interval.

16. The inflatable pillow as in claim 14, wherein said air pump is activated for a period of time under 10 milliseconds for the purposes of delivering said silent alarm.

17. The inflatable pillow as in claim 1 further comprising a stretchable pillow cover surrounding both said top comfort portion and said inflatable portion of said inflatable pillow.

18. The inflatable pillow as in claim 7 further equipped with a wireless transmission link to a cellular phone, tablet or a personal computer running a mobile application configured to receive sleep data accumulated using said altimeter data.

19. The inflatable pillow as in claim 18, wherein said mobile application is further configured to receive user input on subjectively perceived quality of sleep as well as environmental, activity and dietary inputs, so as to facilitate correlation analysis and provide actionable recommendations as to improvements in sleep quality.

* * * * *